US009622630B2

(12) United States Patent
Faremo et al.

(10) Patent No.: US 9,622,630 B2
(45) Date of Patent: Apr. 18, 2017

(54) UPRIGHT VACUUM CLEANER HAVING A SUPPORT

(75) Inventors: Simon Faremo, Stockholm (SE); Mats Sundin, Stockholm (SE)

(73) Assignee: Aktiebolaget Electrolux (SE)

( * ) Notice: Subject to any disclaimer, the term of this patent is extended or adjusted under 35 U.S.C. 154(b) by 272 days.

(21) Appl. No.: 14/386,560

(22) PCT Filed: Mar. 19, 2012

(86) PCT No.: PCT/EP2012/054763

§ 371 (c)(1),
(2), (4) Date: Oct. 9, 2014

(87) PCT Pub. No.: WO2013/139364

PCT Pub. Date: Sep. 26, 2013

(65) Prior Publication Data

US 2015/0067981 A1 Mar. 12, 2015

(51) Int. Cl.

| | |
|---|---|
| ***A47L 9/00*** | (2006.01) |
| ***A47L 9/04*** | (2006.01) |
| ***A47L 5/28*** | (2006.01) |
| ***A47L 9/32*** | (2006.01) |

(52) U.S. Cl.

CPC ..... *A47L 5/28* (2013.01); *A47L 9/009* (2013.01); *A47L 9/0054* (2013.01); *A47L 9/32* (2013.01)

(58) Field of Classification Search

CPC ... A47L 9/00; A47L 9/32; A47L 9/009; A47L 5/28

USPC ..... 15/361, 410

See application file for complete search history.

(56) References Cited

U.S. PATENT DOCUMENTS

| | | | | |
|---|---|---|---|---|
| 2,763,887 A | | 9/1956 | Brace | |
| 3,346,896 A | | 10/1967 | Arones | |
| 3,634,905 A | * | 1/1972 | Boyd | A47L 5/30 15/350 |
| 3,639,939 A | * | 2/1972 | Crener | A47L 11/20 15/320 |
| 4,334,337 A | | 6/1982 | Miller | |
| 5,014,386 A | * | 5/1991 | Worwag | A47L 5/26 15/339 |
| 5,323,510 A | * | 6/1994 | Redding | A47L 9/009 15/323 |
| 5,524,321 A | * | 6/1996 | Weaver | A47L 5/225 15/323 |

(Continued)

FOREIGN PATENT DOCUMENTS

| | | |
|---|---|---|
| EP | 1356755 | 10/2003 |
| GB | 2435820 | 9/2007 |

(Continued)

OTHER PUBLICATIONS

International Preliminary Report on Patentability and Written Opinion for PCT/US2011/027938, mailed Sep. 18, 2012.

(Continued)

*Primary Examiner* — Michael Jennings
(74) *Attorney, Agent, or Firm* — RatnerPrestia

(57) ABSTRACT

An upright vacuum cleaner having a nozzle and a support movable between a projected state and a retracted state. The support, in its projected state, is adapted to support the vacuum cleaner in a self-standing position. The support is mounted to the nozzle and projects from the nozzle in its projected state.

18 Claims, 5 Drawing Sheets

(56) References Cited

U.S. PATENT DOCUMENTS

| | | | | |
|---|---|---|---|---|
| 5,584,095 | A | 12/1996 | Redding | |
| 6,006,401 | A | 12/1999 | Jailor | |
| 6,920,665 | B2 | 7/2005 | Tucker | |
| 7,150,693 | B2 | 12/2006 | Ishimaru | |
| 7,383,608 | B2 * | 6/2008 | Odachi | A47L 9/009 15/361 |
| 7,516,838 | B2 | 4/2009 | Dutschke | |
| 7,607,196 | B2 * | 10/2009 | Li | A47L 5/28 15/350 |
| 7,610,653 | B2 | 11/2009 | Courtney | |
| 7,805,804 | B2 * | 10/2010 | Loebig | A47L 5/28 15/351 |
| 7,950,102 | B2 * | 5/2011 | Lee | A47L 9/325 15/327.4 |
| 8,667,643 | B2 * | 3/2014 | Simonelli | A47L 9/009 15/143.1 |
| 8,677,556 | B2 * | 3/2014 | Seo | A47L 5/28 15/351 |
| 8,869,349 | B2 * | 10/2014 | Henderson | A47L 5/28 15/411 |
| 2005/0223516 | A1 * | 10/2005 | Courtney | A47L 5/28 15/351 |
| 2005/0235454 | A1 * | 10/2005 | Courtney | A47L 5/28 15/351 |
| 2006/0207054 | A1 * | 9/2006 | Loebig | A47L 5/28 15/351 |
| 2006/0288520 | A1 * | 12/2006 | Oh | A47L 9/325 15/351 |
| 2008/0040883 | A1 | 2/2008 | Beskow | |
| 2008/0115313 | A1 * | 5/2008 | Dyson | A47L 5/28 15/336 |
| 2008/0235899 | A1 * | 10/2008 | Haan | A47L 9/122 15/320 |
| 2009/0056064 | A1 * | 3/2009 | Finke | A47L 9/0036 15/352 |
| 2009/0056065 | A1 * | 3/2009 | Finke | A47L 9/009 15/354 |
| 2009/0064449 | A1 * | 3/2009 | Newton | A47L 5/28 15/327.1 |
| 2009/0089969 | A1 * | 4/2009 | Lee | A47L 9/325 15/411 |
| 2009/0165242 | A1 * | 7/2009 | Lee | A47L 5/28 15/411 |
| 2010/0236017 | A1 * | 9/2010 | Krebs | A47L 9/0666 15/363 |
| 2011/0219569 | A1 * | 9/2011 | Vines | A47L 5/28 15/340.2 |
| 2011/0219581 | A1 * | 9/2011 | Vines | A47L 5/28 15/410 |
| 2012/0030900 | A1 * | 2/2012 | Seo | A47L 5/28 15/354 |
| 2012/0060322 | A1 * | 3/2012 | Simonelli | A47L 9/009 15/411 |
| 2013/0086768 | A1 | 4/2013 | Nishimura | |

FOREIGN PATENT DOCUMENTS

| | | |
|---|---|---|
| WO | 2008037955 | 4/2008 |
| WO | 2011158454 | 12/2011 |

OTHER PUBLICATIONS

International Search Report for PCT International Application No. PCT/EP2012/054763 dated Dec. 3, 2012.

International Search Report for PCT International Application No. PCT/US2011/27938, mailed May 10, 2011.

International Search Report for PCT International Application No. PCT/US2011/27957, mailed May 13, 2011.

Office Action for Canadian Patent Application No. 2,791,375 dated Jul. 30, 2014.

Office Action for Canadian Patent Application No. 2,791,375 dated Oct. 18, 2013.

Office Action for Chinese Patent Application No. 201180013639.8 dated Jun. 18, 2014, including English Translation.

Office Action for Great Britain Patent Application No. GB1215754.1 dated Apr. 22, 2014.

Entire patent prosecution history for U.S. Appl. No. 12/722,877, filed Mar. 10, 2010, entitled, "Vacuum Cleaner With Movable Wheel," now U.S. Pat. No. 8,656,552, issued Feb. 25, 2014.

Chinese Office Action dated Nov. 26, 2015 for Chinese Application No. 201280072750.9.

* cited by examiner

UPRIGHT VACUUM CLEANER HAVING A SUPPORT

This application is a National Stage Application of International Application No. PCT/EP2012/0524763, filed Mar. 19, 2012, the entire disclosure of which is expressly incorporated by reference herein.

FIELD OF THE INVENTION

The present invention generally relates to the field of upright vacuum cleaners and in particular, to upright vacuum cleaners having a support for supporting the vacuum cleaner in a self standing upright position.

BACKGROUND OF THE INVENTION

Upright vacuum cleaners comprise an elongated main body, in which the main components of the vacuum cleaner are arranged (such as the motor, fan and dust container), and a nozzle pivotally mounted to the main body. When the vacuum cleaner is used for cleaning, the user inclines the main body and moves the nozzle over the floor by maneuvering a handle at the main body. When the user wishes to leave the vacuum cleaner, it must be leaned against a wall or furnish, laid down on the floor or put in a charging stand, as the vacuum cleaner normally is not able to stand upright by itself. For allowing the user to leave the vacuum cleaner in a self standing upright position, the vacuum cleaner needs to be provided with a support. An upright vacuum cleaner comprising a support is for example disclosed in WO2009/030885. The support is located at a rear portion of the main body of the vacuum cleaner and is movable between a supporting position, in which it supports the main body in an upright position, and a stored position. Such a vacuum cleaner is however rather bulky and it would be desirable to provide a less bulky vacuum cleaner with a support arrangement enabling the vacuum cleaner to stand in a self standing position.

SUMMARY OF THE INVENTION

Thus, there is a need for providing alternatives and/or new devices that would overcome, or at least alleviate or mitigate, the above mentioned drawback. It is with respect to the above considerations that the present invention has been made. An object of the present invention is to provide an improved alternative to the above mentioned technique and prior art. More specifically, it is an object of the present invention to provide a less bulky upright vacuum cleaner.

These and other objects of the present invention are achieved by means of the upright vacuum cleaner as defined in the independent claim. Preferred embodiments are defined in the dependent claims.

According to an aspect of the present invention, there is provided an upright vacuum cleaner comprising a nozzle and a support movable between a projected state and a retracted state, wherein the support in its projected state is adapted to support the vacuum cleaner in a self standing position. The support is mounted to the nozzle and projects from the nozzle in its projected state.

The applicant has found that by mounting the support (preferably directly) to the nozzle, and thereby closer to the underlying surface, instead of higher up at the main body of the vacuum cleaner (as in prior art), the length of the support can be shorter for obtaining a certain support area. In the present disclosure, the term "support area" refers to a base of support (or area) defined by the boundaries between outer supporting points of a body standing on an underlying surface. When the line of gravity (i.e., the imaginary vertical line through the center of mass) of a body is within the support area, the body is in balance, and when the line of gravity is outside the support area, the body will overbalance. When it comes to upright vacuum cleaners able to stand in a self standing parking position, it is desirable to provide a sufficiently large support area for the vacuum cleaner to stand safely. If the support is mounted at the main body of the vacuum cleaner (as in prior art), and thereby higher up at the vacuum cleaner, the support needs to be longer, as it has to reach from the main body and slantingly downwards to the underlying surface (or floor), for obtaining the same support area. Hence, as the support of the vacuum cleaner according to the present invention has a reduced size, the support is less bulky as compared to prior art, whereby a less bulky upright vacuum cleaner is provided.

In embodiments of the present invention, the support may, in its retracted state, be arranged within, and/or along the outside (or outline) of, the nozzle, which is advantageous in that the nozzle and the support form a more slimline unit when the support is in its retracted state, whereby the support is less visible and also less obstructing during cleaning. It will be appreciated that the support in its retracted state may be arranged partly within and partly along the outside of the nozzle (e.g. in case of a slidable support as will be described further on). Further, the support may in its retracted state form an integrated part of the nozzle, which is advantageous in that it further slimline the nozzle with the support.

According to embodiments of the present invention, the support may be provided with a wheel, thereby enabling the support to roll on an underlying surface, which may be used when projecting and retracting the support. The present embodiment reduces the risk of the support scratching the floor during projection and retraction, and facilitates moving the support between its projected and retracted states. Further, the wheel may be adapted to support the nozzle on the underlying surface when the support is in its retracted state, thereby reducing the need of additional wheels or rollers mounted directly to the underside of the nozzle. Hence, the wheel may be mounted to the support such that the wheel provides a gap between the underside of the nozzle and the underlying surface when the support is in the retracted state, whereby the wheel may as well function as a nozzle wheel for facilitating operation of the nozzle over the floor during cleaning.

According to embodiments of the present invention, the support may be pivotally mounted to the nozzle, whereby the support is pivotal between its projected and retracted states. For example, the support may be mounted to the nozzle by means of a hinged connection. For providing a more stable balancing of the vacuum cleaner in the self standing parking position, the support may preferably be pivotally mounted to the rear portion of the nozzle (or the portion of the nozzle at which the main body is mounted), such that the support is pivotal between a projected state, in which the support projects backwards (further away from the main body) from the rear portion of the nozzle, and a retracted state, in which the support may preferably be arranged along the outside of the nozzle.

The support may for instance be vertically pivotal, whereby the support is pivotal in a plane substantially perpendicular to the underlying surface, or in other words, in a plane substantially parallel with the longitudinal direction of the vacuum cleaner being in an upright parking position. Alternatively, the support may be horizontally pivotal, whereby the support is pivotal in a plane substantially parallel to the underlying surface, or in other words, in a plane substantially perpendicular to the longitudinal direction of the vacuum cleaner being in an upright parking position.

According to an alternative embodiment, the support may be slidably mounted to the nozzle, whereby the support is slidable between its projected and retracted states. For example, the support may be slidable into and out of a recess provided in the nozzle, and/or along the outside of the nozzle.

According to embodiments of the present invention, the vacuum cleaner may further comprise an actuator adapted to actuate (or activate) projection of the support to its projected state, whereby a user may control the actuator for projecting the support. Optionally, the actuator may as well be adapted to actuate retraction of the support to its retracted state. With the present embodiments, projection and/or retraction of the support is more user friendly. For example, the actuator may comprise resilient means adapted to exert a force on the support urging the support towards the projected state (or alternatively towards the retracted state), and holding means adapted to hold the support in the retracted state (or alternatively in the projected state), wherein the resilient means is pre-stressed, and release the support from the holding means upon actuation. Alternatively, or as a complement, the actuator may comprise a lever arrangement (of any convenient shape) connected to the support, whereby a user may move the lever arrangement to control the support.

In embodiments of the present invention, the vacuum cleaner may further comprise a main body pivotally mounted to the nozzle. Further, the actuator may be adapted to actuate the projection (of the support) when the main body is put (or placed) in an upright parking position. The present embodiment is advantageous in that moving the vacuum cleaner from a cleaning position, in which the main body may be inclined and the support is retracted, to a self standing parking position, in which the main body is upright (its lengthwise direction being substantially vertical) and the support is projected, activates the projection of the support. Placing the vacuum cleaner in an upright standing position is therefore even further facilitated as the user may simply raise the main body to an upright position for actuating projection of the support. In the present embodiment, the actuator may for instance comprise resilient means and holding means as described above, wherein the holding means may be adapted to release the support when the main body reaches the upright position.

In an embodiment, the actuator may be adapted to be manually operated. For example, the actuator may comprise a button, pedal and/or lever adapted to be manually operated by a user.

Further objectives of, features of, and advantages with, the present invention will become apparent when studying the following detailed disclosure, the drawings and the appended claims. Those skilled in the art realize that different features of the present invention can be combined to create embodiments other than those described in the following.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, in which.

All the figures are schematic, not necessarily to scale, and generally only show parts which are necessary in order to elucidate the invention, wherein other parts may be omitted or merely suggested.

DETAILED DESCRIPTION OF EMBODIMENTS

Figure 1:
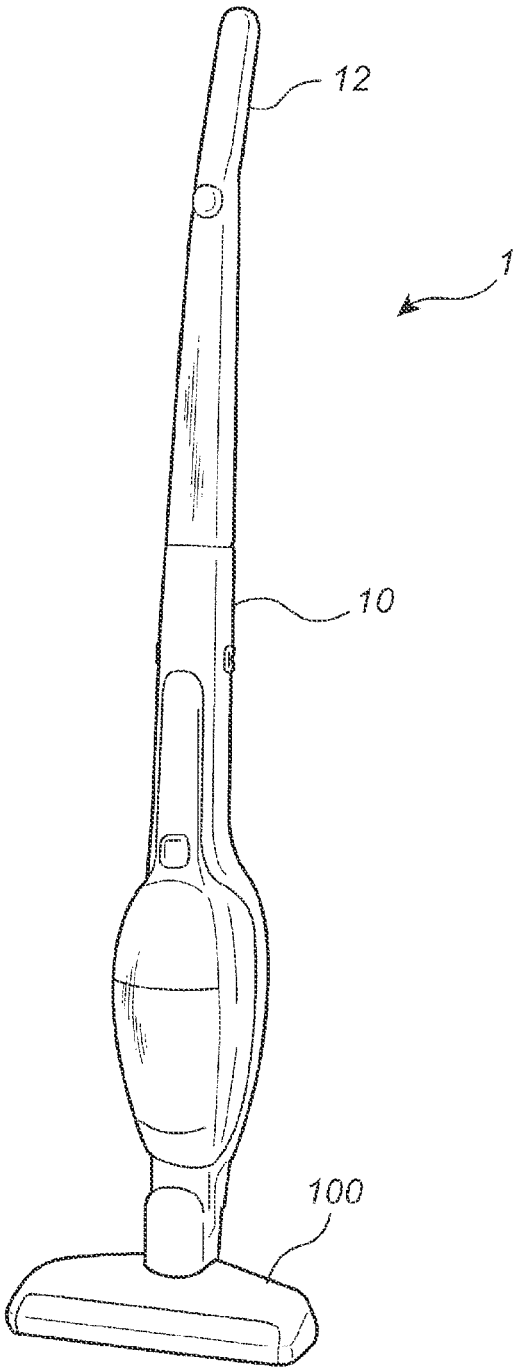
FIG. 1 shows an upright vacuum cleaner according to an embodiment of the present invention.

An upright vacuum cleaner 1 according to an embodiment of the present invention will be described with reference to FIG. 1. The vacuum cleaner 1 comprises a main body 10 to which a nozzle 100 is pivotally mounted. The main body 10 may be elongated and preferably provided with a handle 12 at its upper end. Further, the main body 10 may comprise a fan, a motor for driving the fan to generate a suction air flow, a dust container for collecting dust and debris, which dust container is in communication with the nozzle 100, and a filter for filtering the air flow from fine particles before it is exhausted from the vacuum cleaner 1.

When the vacuum cleaner 1 is used for cleaning, the main body 10 is inclined relative to the nozzle 100 and the user uses the handle 12 to move the nozzle 100 on an underlying surface (or floor) to be cleaned. For allowing the user to leave the vacuum cleaner 1 in a self standing position (or at least let go of the handle 12), the vacuum cleaner 1 is provided with a support (not shown in FIG. 1), which will be described in more detail in the following.

Figure 2A:
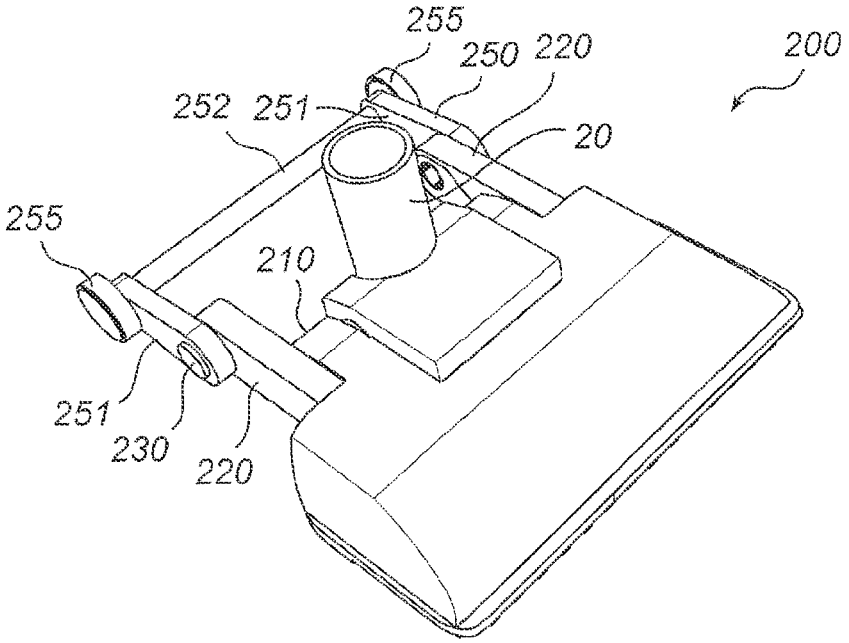
FIG. 2*a* shows a nozzle of an upright vacuum cleaner according to an embodiment of the present invention, wherein a support is mounted to the nozzle and is in a projected state.
Figure 2B:
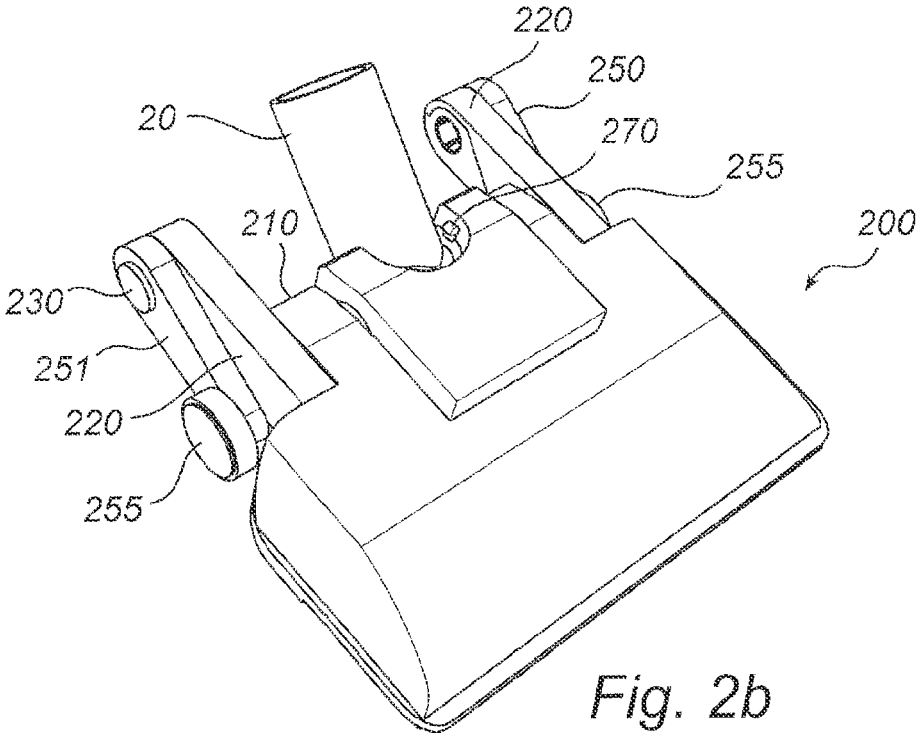
FIG. 2*b* shows the nozzle of FIG. 2*a* but when the support is in a retracted state.
Figure 2C:
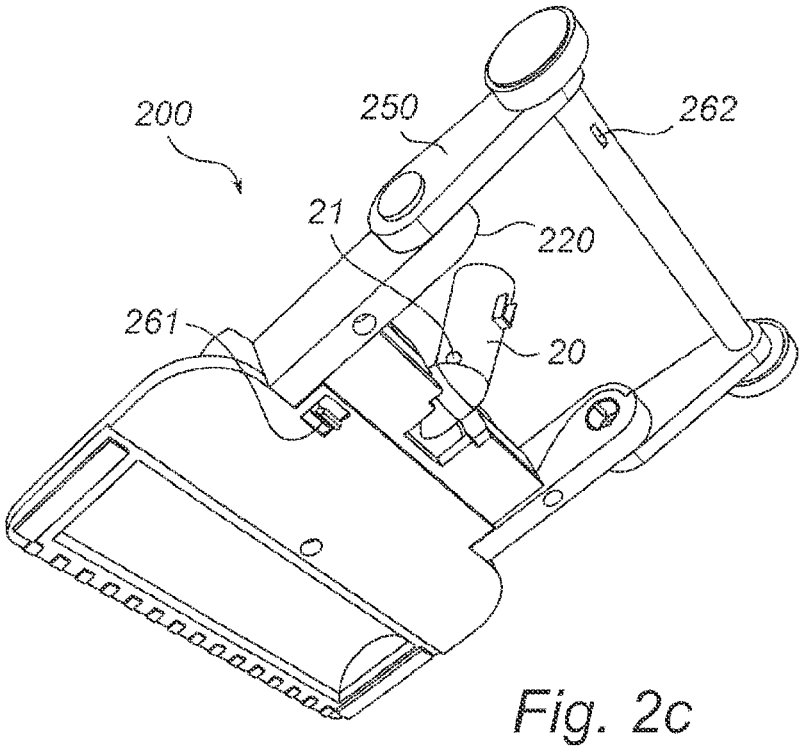
FIG. 2*c* shows the underside (or bottom view) of the nozzle shown in FIG. 2*a;*

FIGS. 2*a*-2*c* show a nozzle 200 of an upright vacuum cleaner according to an embodiment of the present invention. The nozzle 200 is pivotally connected to the lower end of the main body 20 (only the lower end of the main body is shown in FIGS. 2*a*-2*c*, the rest of the main body 20 is omitted for not obscuring the figures). To the nozzle 200, a support 250 is mounted, preferably to the rear part (or side) 210 of the nozzle 200, i.e. preferably to the same side of the nozzle 200 as the main body 20 is mounted. Optionally, the support 250 may be mounted to a portion 220 protruding from the nozzle 200.

In the present embodiment, the support 250 is pivotally mounted to the nozzle 200 by means of a hinge 230, such that the support 250 is vertically pivotal (i.e., pivotal in a plane substantially perpendicular to the underlying surface, or in other words, in a plane substantially parallel with the longitudinal direction of the vacuum cleaner being in an upright parking position). The support 250 may for example comprise two pivotal legs 251, each connected by the hinges 230 to the nozzle 200 (or protruding portion 220), and optionally interconnected by a cross bar 252. Further, the support 250 may be provided with wheels 255, preferably arranged at the distal ends of the legs 251.

The support 250 is pivotal between a projected state (shown in FIGS. 2*a* and 2*c*) and a retracted state (shown in FIG. 2*b*). In the projected state, the support 251 projects from the nozzle 200, preferably backwards (i.e. out from the rear part 210 of the nozzle 200), wherein outer supporting points of the vacuum cleaner against the underlying surface are formed by the wheels 255 (or distal ends) of the support 250 and the front part of the nozzle 200. Hence, a support area for the vacuum cleaner is defined by the boundaries interconnecting these outer supporting points. When the main body 20 is in an upright position and the support 250 is in a projected state (as shown in FIG. 2*a*), the line of gravity of the vacuum cleaner will be within said support area and the vacuum cleaner will thus be able to stand in a self standing position without any need of additional support. Preferably, the vacuum cleaner may comprise locking means 270 for fixing the main body 20 relative to the nozzle 200 in the upright position. The locking means 270 may be formed by protrusions on the nozzle 200 and matching recesses 21 may be arranged on the main body 20 (as shown in FIG. 2*c*) for snap locking the main body 20 in the upright position. When the support 250 is in its retracted state, it is arranged along the outside (or outer surface) of the nozzle 200, as shown in FIG. 2*b*. For example, the legs 251 may be arranged along the sides of the nozzle 200 and the cross bar 252 may be arranged along the underside of the nozzle 200. When the support 250 is in its retracted state, it forms an integral part of the nozzle 200 and is therefore less obstructing during cleaning.

Further, an actuator may be arranged at the nozzle 200 for actuating projection of the support 250 from the retracted state to the projected state. The actuator may comprise resilient means (not shown), such as a spring, adapted to exert a force on the support 250 urging the support 250 towards the projected state. Further, the actuator may comprise holding means 261 (shown in FIG. 2*c*) adapted to hold the support 250 in the retracted state and release the support 250 upon actuation, which may be done by putting the main body 20 in an upright position (such as when the angle between the underlying surface and the main body exceeds e.g. about 85 degrees). The holding means 261 may e.g. comprise a hook 261 arranged at the underside of the nozzle 200, the hook 261 being adapted to hook (or snap lock) the support 250 to the underside of the nozzle 200. When the main body 20 is put in an upright position, the hook 261 is brought to unhook the support 250, whereby the support 250 is urged towards its projected state. For bringing the support 250 back to its retracted state, the user may e.g. push the cross bar 252 and slightly raise the rear part of the nozzle 200, thereby urging the support 250 to pivot to its retracted state.

Figure 3A:
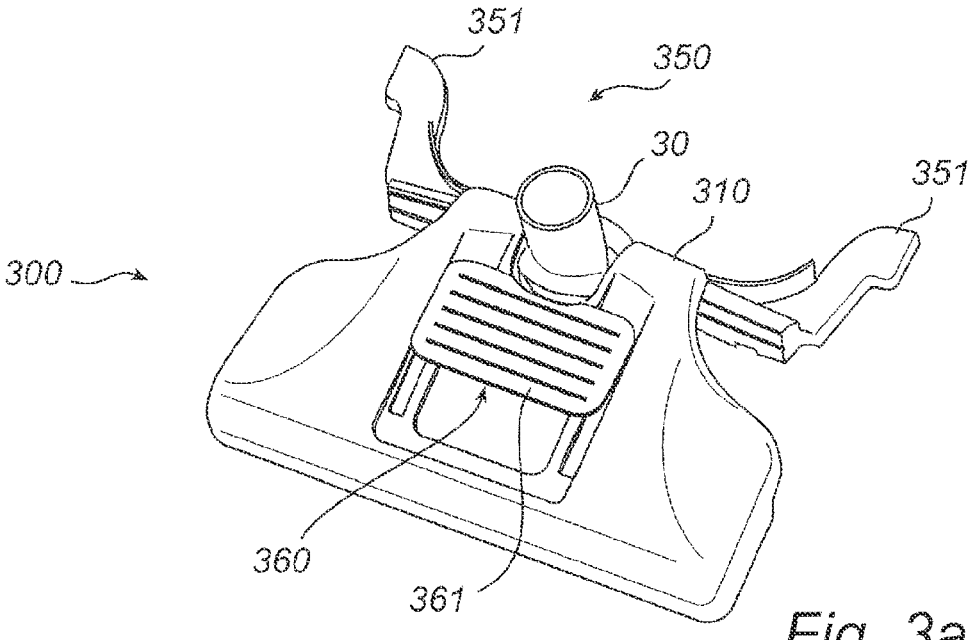
FIG. 3*a* shows a nozzle of an upright vacuum cleaner according to another embodiment of the present invention, wherein a support is mounted to the nozzle and is in a projected state.
Figure 3B:
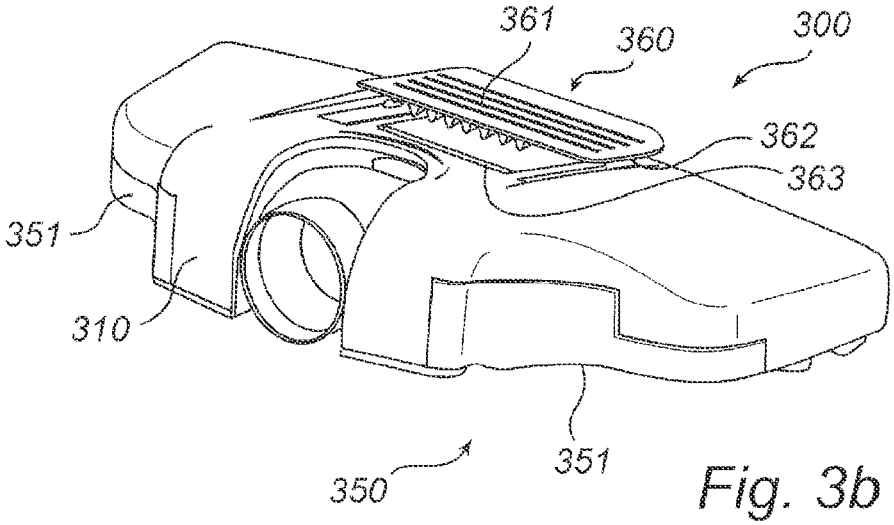
FIG. 3*b* shows the nozzle of FIG. 3*a* but when the support is in a retracted state.

With reference to FIGS. 3*a* and 3*b*, a nozzle 300 with a support arrangement according to another embodiment of the present invention will be described. It will be appreciated that the basic function and operation principle of the support and nozzle 300 shown in FIGS. 3*a* and 3*b* may be the same as (or similar to) the operation principle of the support and nozzle described with reference to FIGS. 2*a*-2*c*. In the present embodiment, the support 350 is horizontally pivotal between its projected state (shown in FIG. 3*a*) and its retracted state (shown in FIG. 3*b*.) The support 350 may comprise two legs 351 pivotally mounted to the nozzle 300 and preferably to the rear portion 310 of the nozzle 300, such that they in the projected state project backwards from the nozzle 300 and in the retracted state are arranged along the outside of the nozzle 300.

Further, an actuator 360 may be arranged at the nozzle 300 for actuating projection of the support 350. In the present embodiment, the actuator 360 may comprise a pedal 361 connected to the support 350 via levers (or rods) 361. When the pedal 361 is moved in one direction, the levers 362 (directly or indirectly) urges the support 350 into its projected state and when it is moved in the other direction, the levers 362 (directly or indirectly) urges the support 350 to its retracted state. Further, a slot 363 may be arranged in the outer cover of the nozzle 300, wherein the pedal 361 may be hooked in the slot 363, for locking the pedal 361 and the support 350 in a certain position (preferably in the projected state). For facilitating hooking and unhooking of the pedal 361 to the nozzle 300, the pedal 361 may be pivotally mounted to the levers 362.

Figure 4:
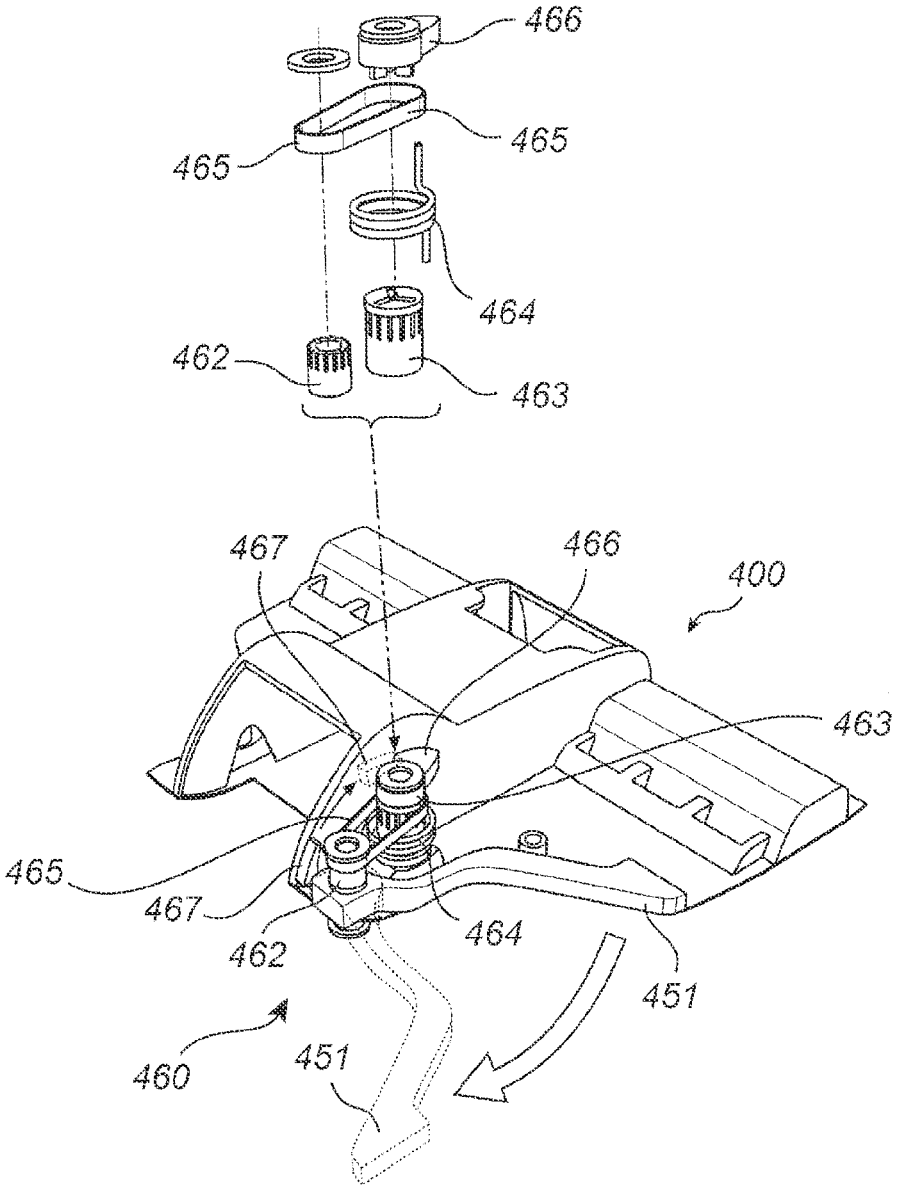
FIG. 4 shows a part of a nozzle of an upright vacuum cleaner according to another embodiment of the present invention.

With reference to FIG. 4, a nozzle 400 with a support according to another embodiment of the present invention will be described. It will be appreciated that the function and the basic operation principle of the support and nozzle 400 shown in FIG. 4 may be the same as (or similar to) the function and the operation principle of the support and nozzle described with reference to FIGS. 2*a*-2*c*. In FIG. 4, the outer cover of the nozzle 400 is omitted for showing an actuator mechanism 460 arranged at the nozzle 400.

A leg 451 of the support of the nozzle 400 is mounted to the nozzle 400 such that it is horizontally (or laterally) pivotal between its projected state (illustrated with dashed lines) and its retracted state (illustrated with solid lines). It will be appreciated that the nozzle 400 may comprise another such a leg 451, symmetrically arranged at the other side of the main body connection of the nozzle 400. The nozzle 400 may further comprise an actuator 460 for actuating projection of the leg 451 of the support. The actuator 460 may comprise a first rotating means 462 fixed to the leg 451 at the hinge connecting the leg 451 to the nozzle 400 and a second rotating means 463 rotatably connected to the nozzle 400. The first and second rotating means 462, 463 are rotatable around substantially vertical parallel axes and may preferably be provided with gear teeth or any other friction enhancing means. A transmission belt 465 is arranged around the first and second rotating means 462, 463, preferably in mesh with the gear teeth, for transmitting the rotational movement from the second to the first rotating means. A pin (or projection) 466 is fixed to the second rotating means 463 and a spring 464 (or any other resilient means) is arranged to urge the second rotating means 463 into a position in which the leg 451 is in a retracted state. An activation means 467 is connected to the main body and movable between a first position (illustrated with solid lines) and a second position (illustrated with dashed lines). When the main body is inclined (such as during cleaning), the activating means 467 is in the first position, in which it does not exert any force (or act) on the pin 466, whereby the spring 464 holds the leg 451 in the retracted state. When the main body is raised to the upright position, the activating means 467 is moved to its second position, in which it pushes the pin 466 (against the force of the spring 464) such that the second rotating means 463 rotates. The rotation of the second rotating means 463 is transmitted by the transmission belt to the first rotating means 462, which in turn rotates the leg 451 to the projected state. The present embodiment is advantageous in that it provides automatic actuation of the projection of the support when the main body is put in an upright position, whereby the actuator does not need to be manually operated. It will be appreciated that such an automatic actuation may be combined with the other embodiments described above, such as with a vertically pivotal support, a slidable support and/or in combination with a pedal arrangement as described with reference to FIGS. 3*a*-3*b*.

While specific embodiments have been described, the skilled person will understand that various modifications and alterations are conceivable within the scope as defined in the appended claims.

The invention claimed is:

1. An upright vacuum cleaner comprising:

a nozzle adapted to rest on an underlying surface; and a support pivotally mounted to the nozzle at a pivot, the pivot being oriented with an axis that is perpendicular to the underlying surface, the support being movable between a projected state and a retracted state, wherein the support in its projected state is adapted to support the vacuum cleaner in a self standing position and the support in its projected state projects from the nozzle;

a control mechanism configured to move the support to the projected state, the control mechanism comprising:

a projecting arm operationally connected to the support such that a force applied to the projecting arm causes the support to move from the retracted state to the projected state, and a drive member movably connected to the nozzle and positioned such that the drive member applies the force to the projecting arm when the drive member is moved to a predetermined position relative to the nozzle.

2. An upright vacuum cleaner as defined in claim 1, wherein the support in its retracted state is arranged within, or along the outside of, the nozzle.

3. An upright vacuum cleaner as defined in claim 1, wherein the support in its retracted state forms an integrated part of the nozzle.

4. An upright vacuum cleaner as defined in claim 1, wherein the support is provided with a wheel.

5. An upright vacuum cleaner as defined in claim 4, wherein the wheel is adapted to support the nozzle on an underlying surface when the support is in its retracted state.

6. An upright vacuum cleaner as defined claim 1, wherein the support is pivotally mounted to the nozzle.

7. An upright vacuum cleaner as defined in claim 6, wherein the support is vertically pivotal.

8. An upright vacuum cleaner as defined in claim 6, wherein the support is horizontally pivotal.

9. An upright vacuum cleaner as defined in claim 1, wherein the support is slidably mounted to the nozzle.

10. An upright vacuum cleaner as defined in claim 1, further comprising a main body pivotally mounted to the nozzle.

11. An upright vacuum cleaner as defined in claim 10, wherein the drive member is located on the main body.

12. An upright vacuum cleaner as defined in claim 11, wherein the drive member is adapted to actuate projection of the support to its projected state when the main body is put in an upright parking position.

13. An upright vacuum cleaner as defined in claim 11, wherein the actuator is adapted to actuate retraction of the support to its retracted state.

14. An upright vacuum cleaner as defined in claim 11, wherein the support is adapted to move to its retracted state when the main body is put in a cleaning position.

15. An upright vacuum cleaner as defined in claim 1, wherein the control member is adapted to be manually operated.

16. An upright vacuum cleaner comprising:

a nozzle adapted to rest on an underlying surface;

a main body pivotally mounted on the nozzle; and a support pivotally mounted to the nozzle at a pivot, the pivot being oriented with an axis that is perpendicular to the underlying surface, the support being movable between a projected state and a retracted state, wherein the support in its projected state extends from the nozzle to support the vacuum cleaner in a self standing position, and wherein the support in its retracted state is flush with the adjacent surface of the nozzle; and a control mechanism configured to move the support to the projected state when the main body is moved to an upright position relative to the nozzle, the control mechanism comprising:

a projecting arm operationally connected to the support such that a force applied to the projecting arm causes the support to move from the retracted state to the projected state, and a drive member operationally connected to and movable with the main body, and positioned such that the drive member applies the force to the projecting arm when the main body is moved into the upright position.

17. The upright vacuum cleaner of claim 16, wherein the control mechanism is operatively connected to the support by a belt.

18. The upright vacuum cleaner of claim 16, wherein the control mechanism further comprises a spring configured to retract the support to the retracted state when the main body is not in the upright position.

* * * * *